US011235950B2

(12) United States Patent
Sanchez Munoz et al.

(10) Patent No.: US 11,235,950 B2
(45) Date of Patent: Feb. 1, 2022

(54) ELEVATOR SAFETY GEAR ACTUATION DEVICE

(71) Applicant: Otis Elevator Company, Farmington, CT (US)

(72) Inventors: Ruben Sanchez Munoz, Madrid (ES); Javier Munoz Sotoca, Rivas-Vaciamadrid (ES)

(73) Assignee: OTIS ELEVATOR COMPANY, Farmington, CT (US)

( * ) Notice: Subject to any disclaimer, the term of this patent is extended or adjusted under 35 U.S.C. 154(b) by 200 days.

(21) Appl. No.: 16/397,512

(22) Filed: Apr. 29, 2019

(65) Prior Publication Data

US 2019/0330021 A1 Oct. 31, 2019

(30) Foreign Application Priority Data

Apr. 30, 2018 (EP) ..... 18170143

(51) Int. Cl.
*B66B 5/22* (2006.01)
*B66B 5/04* (2006.01)

(52) U.S. Cl.
CPC . *B66B 5/22* (2013.01); *B66B 5/04* (2013.01)

(58) Field of Classification Search
CPC ..... B66B 5/22; B66B 5/04
See application file for complete search history.

(56) References Cited

U.S. PATENT DOCUMENTS 5,141,082 A * 8/1992 Ishii ..... H02K 41/03 187/289
5,566,784 A * 10/1996 Rennetaud ..... B66B 9/02 187/249

(Continued)

FOREIGN PATENT DOCUMENTS

CN 101966950 A 2/2011
CN 202156857 U 3/2012

(Continued)

OTHER PUBLICATIONS

European Search Report for application EP 18170145.9, dated Nov. 19, 2018, 7 pages.

(Continued)

*Primary Examiner* — Michael A Riegelman
(74) *Attorney, Agent, or Firm* — Cantor Colburn LLP

(57) ABSTRACT

An elevator safety gear actuation device for actuating an elevator safety gear comprises a first member and a second member. The first and second members are arranged opposite to each other defining a gap configured for accommodating a guide member extending in a longitudinal direction. At least one of the engagement members comprises an engagement element which is movable in a direction transverse to the longitudinal direction between a disengaged position and an engaged position. The first engagement element comprises at least one permanent magnet which is configured for being magnetically attracted and attaching to the guide member extending through the gap when the engagement element is arranged in the engaged position. The second member comprises at least one additional permanent magnet which is configured for being magnetically attracted to the guide member extending through the gap.

14 Claims, 4 Drawing Sheets

(56) References Cited

U.S. PATENT DOCUMENTS

| | | | | |
|---|---|---|---|---|
| 5,810,120 | A * | 9/1998 | Jamieson | B66B 7/042 187/292 |
| 6,305,502 | B1 * | 10/2001 | He | B66B 11/0286 187/292 |
| 7,924,128 | B2 * | 4/2011 | Ito | G01G 7/02 335/229 |
| 9,663,327 | B2 * | 5/2017 | Terry | B66B 5/20 |
| 2007/0000732 | A1 * | 1/2007 | Kulak | B66B 7/044 187/346 |
| 2009/0294222 | A1 * | 12/2009 | Piech | B66B 7/046 187/410 |
| 2011/0088983 | A1 * | 4/2011 | Sirigu | B66B 5/22 187/373 |
| 2016/0236904 | A1 * | 8/2016 | Witczak | B66B 5/22 |
| 2017/0001835 | A1 * | 1/2017 | Hu | B66B 5/18 |
| 2017/0066627 | A1 * | 3/2017 | Hu | B66B 5/18 |
| 2017/0107078 | A1 * | 4/2017 | Hu | B66B 5/22 |
| 2017/0129741 | A1 * | 5/2017 | Hu | B66B 5/18 |
| 2017/0283216 | A1 * | 10/2017 | Marvin | B66B 5/0031 |
| 2017/0283217 | A1 * | 10/2017 | Marvin | B66B 5/0031 |
| 2017/0291798 | A1 * | 10/2017 | Hu | B66B 5/22 |
| 2017/0349408 | A1 * | 12/2017 | Villa | B66B 7/042 |
| 2018/0162693 | A1 * | 6/2018 | Hu | B66B 7/048 |
| 2018/0162694 | A1 * | 6/2018 | Hu | B66B 5/18 |
| 2018/0327224 | A1 * | 11/2018 | Billard | B66B 5/22 |
| 2019/0062113 | A1 * | 2/2019 | Hu | B66B 5/18 |
| 2019/0330020 | A1 * | 10/2019 | Sanchez Munoz | B66B 5/06 |
| 2019/0330021 | A1 * | 10/2019 | Sanchez Munoz | B66B 5/04 |
| 2020/0031621 | A1 * | 1/2020 | Khzouz | B66B 5/22 |
| 2020/0048042 | A1 * | 2/2020 | Sanchez Munoz | B66B 5/18 |
| 2020/0071129 | A1 * | 3/2020 | Ruhnke | B66B 9/00 |
| 2020/0115189 | A1 * | 4/2020 | Dube | F16D 63/002 |
| 2020/0130985 | A1 * | 4/2020 | Ruhnke | B66B 1/3492 |
| 2020/0270098 | A1 * | 8/2020 | Mustafa | B66B 9/00 |

FOREIGN PATENT DOCUMENTS

| | | | |
|---|---|---|---|
| CN | 104787640 | A | 7/2015 |
| EP | 3231756 | A1 | 10/2017 |
| EP | 3342741 | A1 | 7/2018 |
| FI | 82918 | B | 1/1991 |
| JP | H08208151 | A | 8/1996 |
| JP | 3171530 | B2 | 5/2001 |
| JP | 3399584 | B2 | 4/2003 |
| JP | 6336383 | B2 | 6/2018 |
| KR | 20140060694 | A | 5/2014 |
| KR | 20150001985 | A | 1/2015 |
| WO | 9323323 | A1 | 11/1993 |
| WO | 2008136692 | A1 | 11/2008 |
| WO | 2017087976 | A1 | 5/2017 |
| WO | 2017183189 | A1 | 10/2017 |

OTHER PUBLICATIONS

European Search Report for application EP 3342741, dated Oct. 25, 2018, 8 pages.

Chinese Office Action for Application No. 201910360557.9; dated Jul. 2, 2020; 9 Pages.

* cited by examiner

ELEVATOR SAFETY GEAR ACTUATION DEVICE

FOREIGN PRIORITY

This application claims priority to European Patent Application No. 18170143.4, filed Apr. 30, 2018, and all the benefits accruing therefrom under 35 U.S.C. § 119, the contents of which in its entirety are herein incorporated by reference.

BACKGROUND

The invention relates to an elevator safety gear actuation device and to an elevator safety gear with such an actuation device. The invention further relates to an elevator car and to an elevator counterweight respectively comprising such an elevator safety gear, and to an elevator system comprising such an elevator car and/or such a counterweight.

An elevator system typically comprises at least one elevator car moving along a hoistway extending between a plurality of landings, and a driving member, which is configured for driving the elevator car. In particular embodiments, the elevator system may further include a counterweight moving concurrently and in opposite direction with respect to the elevator car. In order to ensure a safe operation, the elevator system further comprises at least one elevator safety gear. An elevator safety gear is configured for braking the movement of the elevator car and/or the counterweight relative to a guide member, such as a guide rail, in an emergency situation, in particular when the movement of the elevator car and/or the counterweight exceeds a predetermined velocity or acceleration.

The elevator safety gear includes an actuation device which is configured for actuating the elevator safety gear.

It would be beneficial to provide an improved actuation device allowing for an enhanced operational reliability and resulting in an increased lifetime of the components.

SUMMARY

According to an exemplary embodiment of the invention, an actuation device for actuating an elevator safety gear (elevator safety gear actuation device) comprises a first member and a second member. The first and second members are arranged opposite to each other defining a gap which is configured for accommodating a guide member extending in a longitudinal direction. The first member comprises an engagement element which is movable in a direction transverse to the longitudinal direction between a disengaged position and an engaged position. The engagement element includes at least one permanent magnet (first permanent magnet) which is configured for being magnetically attracted by the guide member extending through the gap and attaching to said guide member when the engagement element is arranged in the engaged position. The second member comprises at least one additional permanent magnet (second permanent magnet) which is configured for being magnetically attracted to the guide member extending through the gap balancing the magnetic force of the first permanent magnet.

The at least one second permanent magnet counterbalances the force actuated onto the guide member by the at least one first permanent magnet and assures that the second member follows the guide member. This supports free running of the actuation device along the guide member when the actuation device is not activated.

Exemplary embodiments of the invention also include an elevator safety gear comprising a braking device and an actuation device according to an exemplary embodiment of the invention. The braking device is mechanically coupled with the actuation device for being actuated, i.e. for being brought into a braking configuration, by the actuation device.

Exemplary embodiments of the invention further include an elevator car and/or a counterweight for an elevator system, respectively comprising at least one elevator safety gear with an actuation device according to an exemplary embodiment of the invention.

Exemplary embodiments of the invention also include an elevator system comprising at least one counterweight according to an exemplary embodiment of the invention and/or at least one elevator car according to an exemplary embodiment of the invention.

A number of optional features are set out in the following. These features may be realized in particular embodiments, alone or in combination with any of the other features, unless specified otherwise.

The at least one additional permanent magnet may be configured for not attaching to the guide member even when the engagement element is positioned in the engaged position.

The at least one additional permanent magnet may be immovably fixed to the second member, or it may be movable transverse to the longitudinal direction.

The at least one second permanent magnet provided at the second member may be arranged basically opposite to the at least one first permanent magnet provided at the first member.

In an alternative configuration, the at least one second permanent magnet may be offset from the at least one first permanent magnet in the longitudinal direction.

The engagement element may have a high friction surface which is configured for generating a high friction between the engagement element and the guide member.

The first member may comprise at least one stopper element configured for delimiting the movement of the engagement element in the longitudinal direction.

The first member in particular may comprise two stopper elements spaced apart in the longitudinal direction, and the at least one permanent magnet may be arranged between the two stopper elements. Such an arrangement provides a first member having a very stable mechanical configuration.

The second member may include at least one low friction element which is configured for providing low friction between the second member and the guide member extending through the gap. Such a low friction element reduces friction between the second member and the guide member, particularly in the disengaged state. Less friction reduces the wear and noise caused by the movement of the second member with respect to the guide member.

In order to reduce the friction between the second member and the guide member, the low friction element may comprise a low friction contact surface facing the guide member extending through the gap.

Said contact surface in particular may be made from or covered by a low friction material having a good wear resistance. The low friction material may be a synthetic material, for example a material based on at least one of polytetrafluoroethylene (PTFE), graphite, polyethylene (PE), ultra high molecular weight polyethylene (UHMWPE), graphene, and polyether ether ketone (PEEK).

The second member may further comprise at least two support elements spaced apart in the longitudinal direction.

The low friction element may be attached to and extend in between the at least two support elements.

In order to allow for an easy replacement of the low friction element, the low friction element may be attached to the support elements by means of a fixing mechanism which is configured for allowing easily detaching the low friction element from the support elements. The fixing mechanism in particular may be a snap-on/clamping mechanism.

In order to reduce friction between the second member and the guide member, the second member may include at least one roller configured for rolling along the guide member extending through the gap, when the second member is arranged in the disengaged position. Said at least one roller may be made at least partially of a synthetic material, e.g. of a rubber material.

The second member may include a plurality of rollers spaced apart from each other in the longitudinal direction.

The second member in particular may comprise two rollers spaced apart from each other in the longitudinal direction, and the at least one second permanent magnet may be arranged between the two rollers. Such an arrangement results in a particularly compact and mechanically stable configuration of the second member.

The actuation device may further comprise an activation mechanism configured for activating the actuation device and causing at least one of the members to move from the disengaged position to the engaged position. The activation mechanism may be an electromagnetic, hydraulic or pneumatic activation mechanism. The activation mechanism may be configured for being triggered by an electric signal.

DESCRIPTION OF DRAWINGS

In the following, exemplary embodiments of the invention are described in more detail with respect to the enclosed figures.

DETAILED DESCRIPTION

Figure 1:
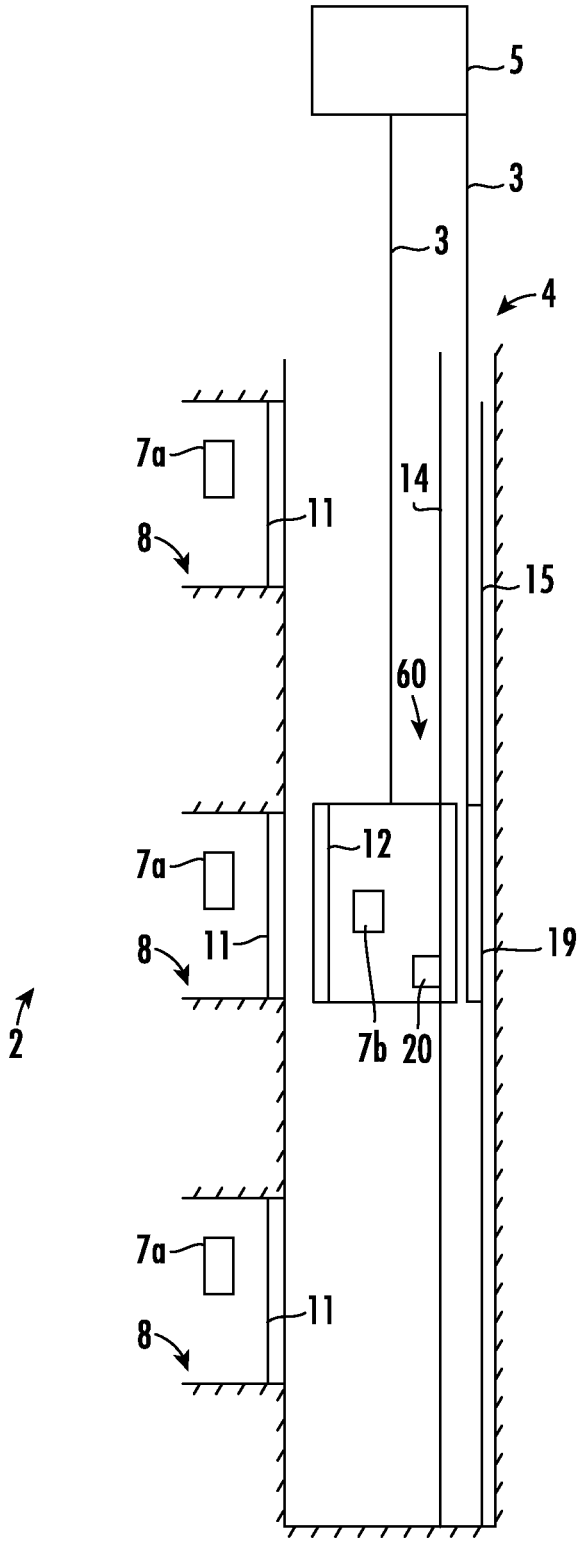
FIG. 1 schematically depicts an elevator system with an elevator safety gear according to an exemplary embodiment of the invention.

FIG. 1 schematically depicts an elevator system 2 according to an exemplary embodiment of the invention.

The elevator system 2 includes an elevator car 60 movably arranged within a hoistway 4 extending between a plurality of landings 8. The elevator car 60 in particular is movable along a plurality of car guide members 14, such as guide rails, extending along the vertical direction of the hoistway 4. Only one of said car guide members 14 is visible in FIG. 1.

Although only one elevator car 60 is depicted in FIG. 1, the skilled person will understand that exemplary embodiments of the invention may include elevator systems 2 having a plurality of elevator cars 60 moving in one or more hoistways 4.

The elevator car 60 is movably suspended by means of a tension member 3. The tension member 3, for example a rope or belt, is connected to a drive unit 5, which is configured for driving the tension member 3 in order to move the elevator car 60 along the height of the hoistway 4 between the plurality of landings 8, which are located on different floors.

Each landing 8 is provided with a landing door 11, and the elevator car 60 is provided with a corresponding elevator car door 12 for allowing passengers to transfer between a landing 8 and the interior of the elevator car 60 when the elevator car 60 is positioned at the respective landing 8.

The exemplary embodiment shown in FIG. 1 uses a 1:1 roping for suspending the elevator car 60. The skilled person, however, easily understands that the type of the roping is not essential for the invention and that different kinds of roping, e.g. a 2:1 roping, a 4:1 roping, or no roping at all may be employed. For example, embodiments may be employed in a ropeless elevator systems using a linear motor to impart motion to an elevator car. Embodiments may also be employed in ropeless elevator systems using a hydraulic lift to impart motion to an elevator car.

The elevator system 2 includes further a counterweight 19 attached to the tension member 3 and moving concurrently and in opposite direction with respect to the elevator car 6 along at least one counterweight guide member 15. The skilled person will understand that the invention may be applied also to elevator systems 2 which do not comprise a counterweight 19.

The tension member 3 may be a rope, e.g. a steel wire rope, or a belt. The tension member 3 may be uncoated or may have a coating, e.g. in the form of a polymer jacket. In a particular embodiment, the tension member 3 may be a belt comprising a plurality of polymer coated steel cords (not shown). The elevator system 2 may have a traction drive including a traction sheave for driving the tension member 3. In an alternative configuration, which is not shown in the figures, the elevator system 2 may be an elevator system 2 without a tension member 103, comprising e.g. a hydraulic drive or a linear drive. The elevator system 2 may have a machine room (not shown) or may be a machine room-less elevator system.

The drive unit 5 is controlled by an elevator control unit (not shown) for moving the elevator car 60 along the hoistway 4 between the different landings 8.

Input to the control unit may be provided via landing control panels 7*a*, which are provided on each landing 8 close to the landing doors 11, and/or via an elevator car control panel 7*b*, which is provided inside the elevator car 60.

The landing control panels 7*a* and the elevator car control panel 7*b* may be connected to the elevator control unit by means of electric wires, which are not shown in FIG. 1, in particular by an electric bus, or by means of wireless data connections.

The elevator car 60 is equipped with at least one elevator safety gear 20, which is schematically illustrated at the elevator car 60. Alternatively or additionally, the counterweight 19 may be equipped with at least one elevator safety gear 20. An elevator safety gear 20 attached to the counterweight 19, however, is not shown in FIG. 1.

The elevator safety gear 20 is operable to brake or at least assist in braking (i.e. slowing or stopping the movement) of the elevator car 60 relative to a car guide member 14 by engaging with the car guide member 14. In the following, the structure and the operating principle of an elevator safety gear 20 according to an exemplary embodiment of the invention will be described.

Figure 2:
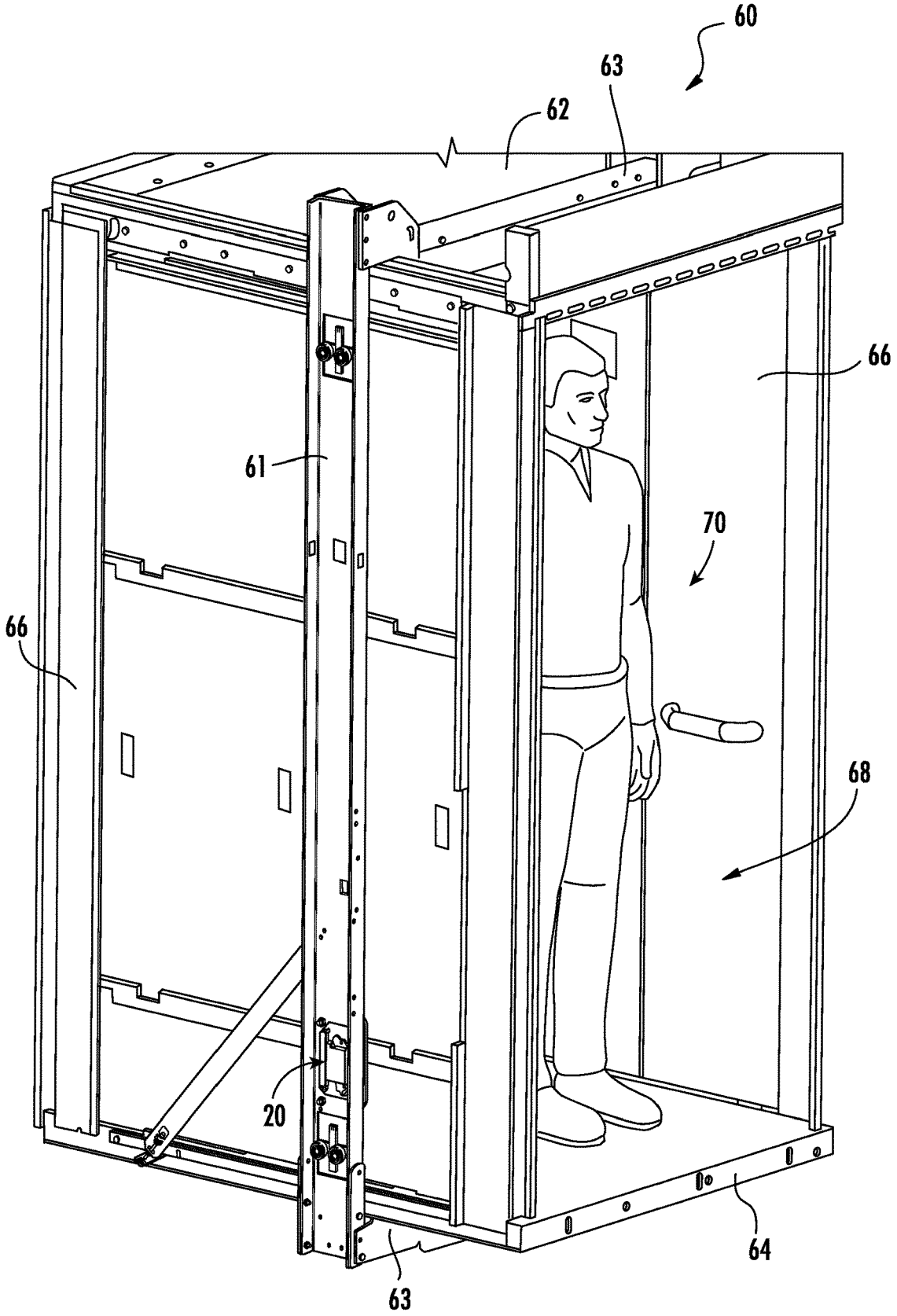
FIG. 2 shows a perspective view of an elevator car comprising an elevator safety gear according to an exemplary embodiment of the invention.

FIG. 2 is an enlarged perspective view of an elevator car 60 according to an exemplary embodiment of the invention. The elevator car 60 comprises a structural frame comprising vertically extending uprights 61 and crossbars 63 extending horizontally between the uprights 61. Only one upright 61 is visible in FIG. 2.

The elevator car 60 further includes a car roof 62, a car floor 64 and a plurality of car side walls 66. In combination, the car roof 62, the car floor 64 and the plurality of side walls 66 define an interior space 68 for accommodating and carrying passengers 70 and/or cargo (not shown).

An elevator safety gear 20 according to an exemplary embodiment of the invention is attached to an upright 61 of the elevator car 60.

Although only one elevator safety gear 20 is depicted in FIGS. 1 and 2, respectively, the skilled person will understand that a plurality of safety gear assemblies 20 may be mounted to a single elevator car 60. In particular, in a configuration in which the elevator system 2 comprises a plurality of car guide members 14, an elevator safety gear 20 may be associated with each car guide member 14.

Alternatively or additionally, two or more elevator safety gears 20 may be provided on top of each other at the same upright 61 of the elevator car 60 in order to engage with the same car guide member 14.

Figure 5:
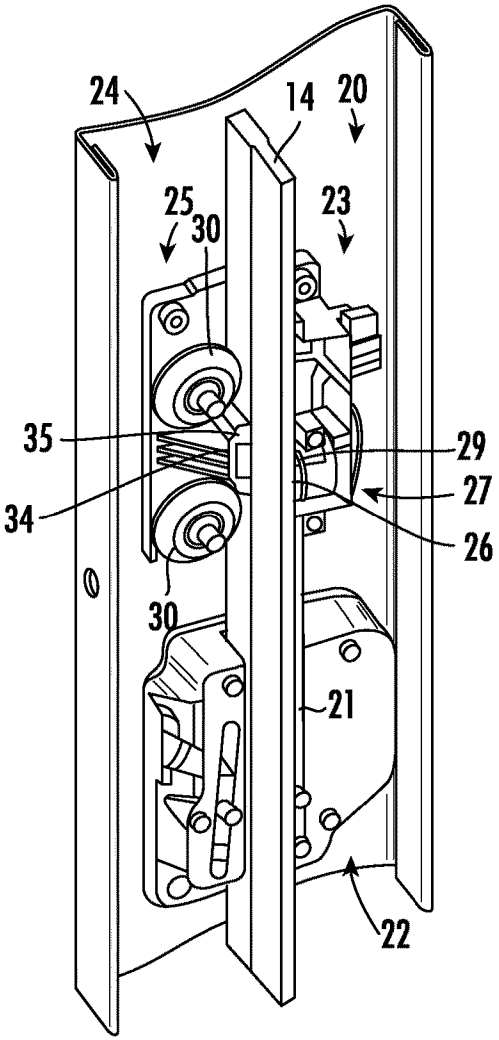
FIGS. 4 and 5 show perspective views of the elevator safety gear shown in FIG. 3, respectively.
Figure 4:
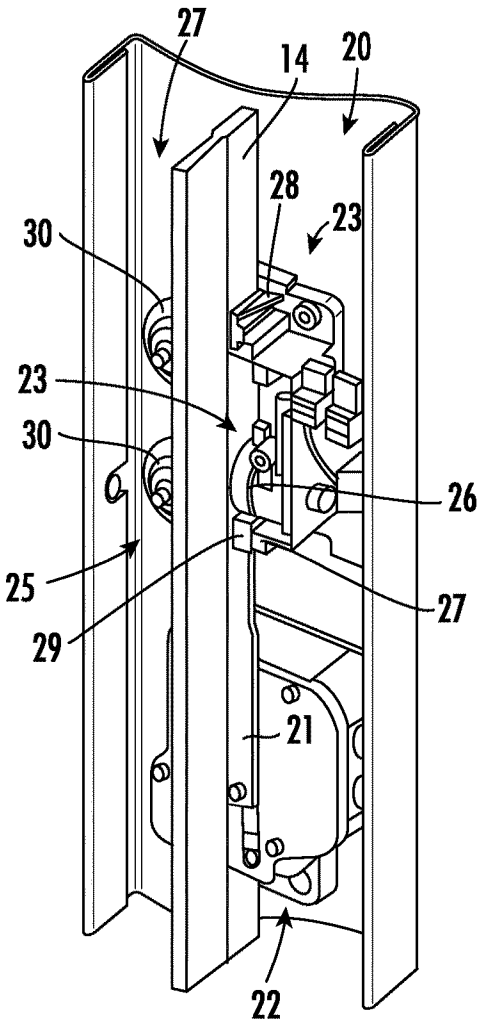
Figure 3:
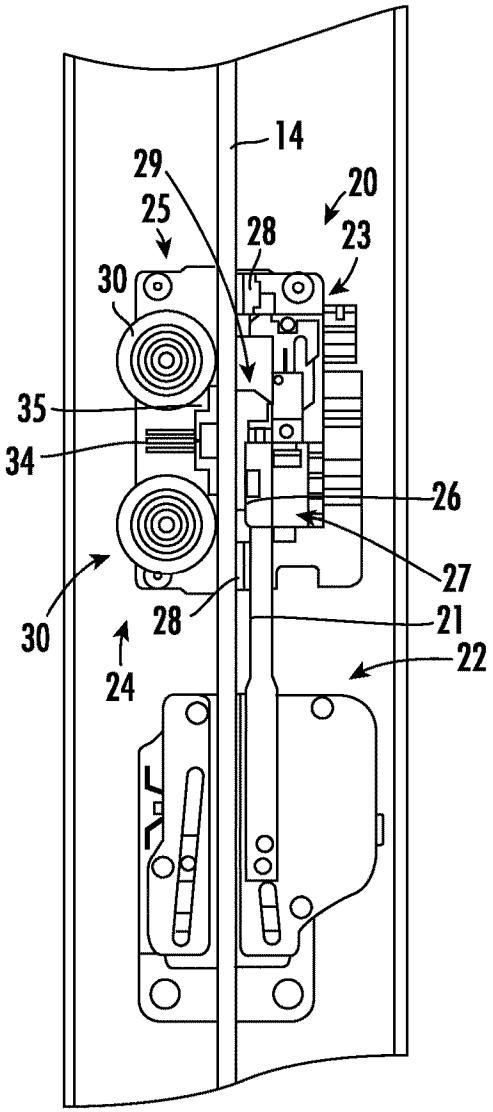
FIG. 3 shows a plane view of an elevator safety gear according to an exemplary embodiment of the invention.

An elevator safety gear 20 according to an exemplary embodiment of the invention is depicted in more detail in FIGS. 3 to 5. FIG. 3 shows a plane view of the elevator safety gear 20. FIGS. 4 and 5 show perspective views of the elevator safety gear 20 from two different angles.

The elevator safety gear 20 comprises a braking device 22 and an actuation device 24. The braking device 22 is configured for engaging with the car guide member 14 in order to brake the movement of the elevator car 60 along the car guide member 14. The braking device 22 is of the self-locking type, e.g. employing a wedge-type construction.

In the embodiment depicted in FIG. 3, the braking device 22 and the actuation device 24 are spaced apart from each other in a longitudinal (vertical) direction along the car guide member 14, but other arrangements of the braking device 22 and the actuation device 24 are possible as well. The braking device 22 and the actuation device 24 also may be integrated into a combined actuation and braking device.

The braking device 22 and the actuation device 24 are mechanically connected with each other by an actuation rod 21 extending along the longitudinal direction, i.e. parallel to the car guide member 14. The actuation device 24 is configured for actuating the braking device 22 via the actuation rod 21.

The braking device 22 is not discussed in detail here. An example of a self-locking braking device 22 as it may be employed in an elevator safety gear 20 according to an exemplary embodiment of the invention is described in detail in the European patent application 17 192 555.5 which in its entirety is incorporated herein by reference.

The actuation device 24 comprises a first member 23 shown on the right side of FIGS. 3 to 5, and a second member 25 shown on the left side of FIGS. 3 to 5, respectively. The first and second members 23, 25 are arranged opposite to each other defining a gap. The car guide member 14 extends through said gap in the longitudinal direction.

The first and second members 23, 25 rigidly connected with each other so that they do not move with respect to each other. The first and second members 23, 25 in particular may be formed integrally with each other representing two portions of the same element.

In the disengaged (released) state, the braking device 22 and the actuation device 24 are not in with the car guide member 14, and they will move together with the elevator car 60 in the longitudinal direction.

The first member 23 comprises a movable engagement element 29, which in particular is movable in a direction transverse to the longitudinal direction (horizontal direction) from its disengaged position into an engaged position. When arranged in the engaged position, the engagement element 29 engages with the car guide member 14. The friction between the car guide member 14 and the engagement element 29 generates a force acting onto the actuation rod 21 activating the braking device 22.

The actuation device 24 comprises an activation mechanism 27 configured for activating the actuation device 20 by causing the engagement element 29 to move from its disengaged position into an engaged position in which it contacts the car guide member 14.

In the embodiment shown in FIGS. 3 to 5, the activation mechanism 27 is provided at the first member 23. The activation mechanism 27 in particular may include an electromagnetic coil. Suitable activation mechanisms 27 are known to the person skilled in the art.

The engagement element 29 comprises at least one permanent magnet 26 (first permanent magnet 26). The at least one first permanent magnet 26 is attracted and attached to the car guide member 14 by a magnetic force when the engagement element 29 is arranged in its engaged position.

The magnetic force enhances the friction between the car guide member 14 and the engagement element 29 contacting the car guide member 14. This effect is called "magnetically attaching". As a result, the braking device 22 is activated fast and reliably.

The first member 23 comprises two stopper elements 28 spaced apart from each other in the longitudinal direction. The engagement element 29 with the at least one permanent magnet 26 is arranged between the two stopper elements 23.

The second member 25 comprises at least one additional permanent magnet 34 (second permanent magnet 34) supported by a magnet holder 35. The at least one second permanent magnet 34 is configured for being magnetically attracted to the guide member 14 extending through the gap counterbalancing the force actuated onto the guide member by the at least one first permanent magnet and assuring that the second member 25 follows the guide member. This supports free running of the actuation device 24 along the guide member 14 as long as the actuation device 24 is not activated.

The at least one additional permanent magnet 34/magnet holder 35 may be movable transverse to the longitudinal direction.

The at least one second permanent magnet 34 is arranged basically opposite to the at least one first permanent magnet 26 of the engagement element 29. In an alternative configuration, which is not shown in the figures, the at least one second permanent magnet 34 may be offset from the at least one first permanent magnet 26 in the longitudinal direction.

The second member 25 optionally supports two rollers 30. When the elevator safety gear 20 moves along the car guide member 14 in the longitudinal direction, the rollers 30 are configured for rolling along the guide member 14 extending through the gap.

The rollers 30 reduce the friction between the elevator safety gear 20, in particular the second member 25, and the car guide member 14 when the actuation device 24 is not activated.

The rollers 30 may be made at least partially from a synthetic material, in particular a durable material, which allows for a low friction between the car guide member 14 and the rollers 30. The rollers 30 in particular may be made at least partially from a rubber material.

In the embodiment depicted in FIGS. 3 to 5, the second permanent magnet 34 is arranged in between the two rollers 30 in the longitudinal direction.

The skilled person, however, will understand that this configuration is only exemplarily and that in alternative configurations not depicted in the figures, the second permanent magnet 34 may be arranged outside, i.e. above or below, the rollers 30.

Further, more or less than two rollers 30 may be used, and/or the second member 25 may comprise more than one second permanent magnet 34. Two or more second permanent magnets 34 may be provided next to each other. Alternatively, the second permanent magnets 34 may be spaced apart from each other in the longitudinal direction.

Figure 8:
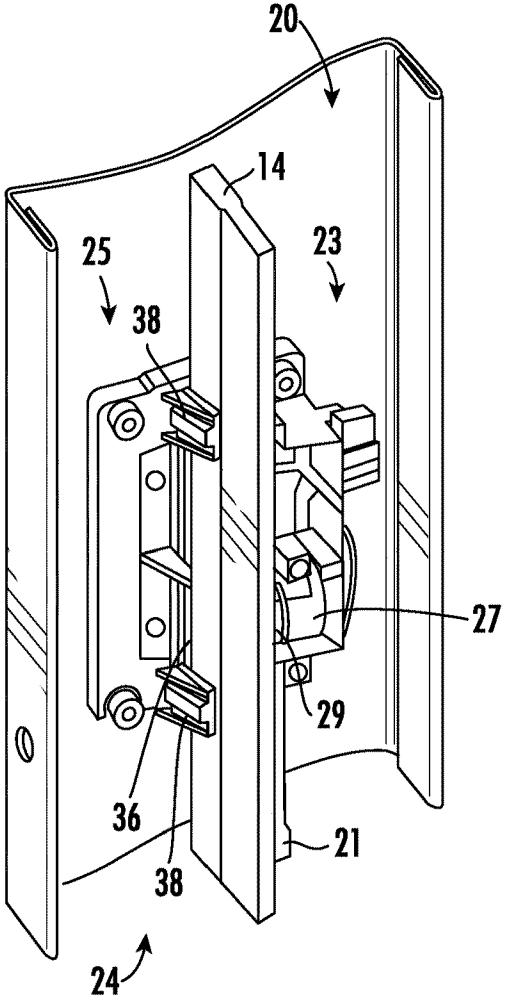
FIGS. 7 and 8 show perspective views of the elevator safety gear shown in FIG. 6, respectively.
Figure 7:
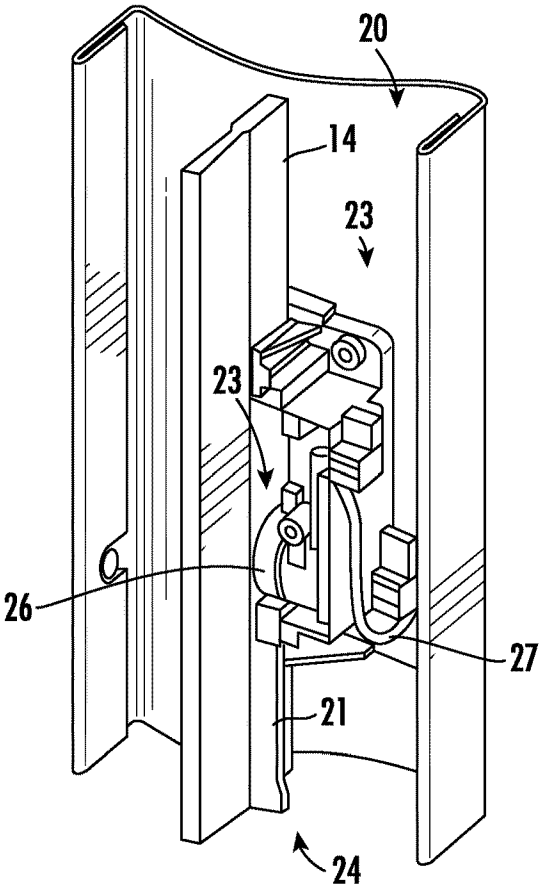
Figure 6:
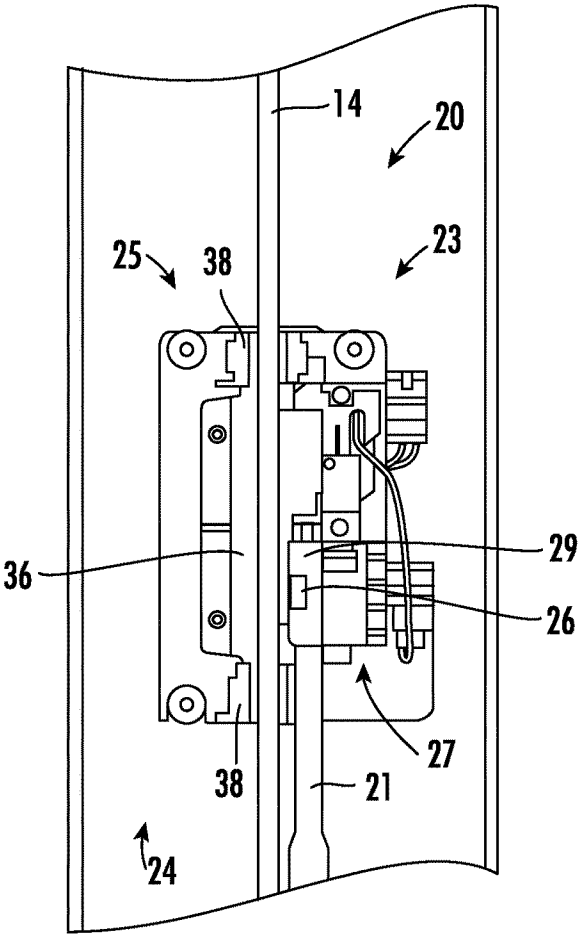
FIG. 6 shows a plane view of an elevator safety gear according to another exemplary embodiment of the invention.

An elevator safety gear 20 according to another exemplary embodiment of the invention is depicted in FIGS. 6 to 8. FIG. 6 shows a plane view of the elevator safety gear 20. FIGS. 7 and 8 show perspective views from two different angles, respectively.

Only the car guide rail 14, the actuation device 24 and the activation rod 21 are depicted in FIGS. 6 to 8, i.e. the braking device 22, which may be identical to the braking device depicted in FIGS. 3 to 5, is not shown.

Similar to the embodiment depicted in FIGS. 3 to 5, the actuation device 24 comprises a first member 23 and a second member 25 forming a gap in between, and the car guide member 14 extends through said gap.

The first member 23 is identical with the first member 23 of the embodiment depicted in FIGS. 3 to 5. It therefore is not discussed in detail again. Reference is made to the respective description of FIGS. 3 to 5. In the following, only the differences between the two embodiments are described.

In the embodiment depicted in FIGS. 6 to 8, the second member 25 does not comprise a second permanent magnet 34 and rollers 30. Instead, the second member 25 comprises a low friction element 36 extending in the longitudinal direction parallel to the car guide member 14.

For reducing the friction between the second member 25 and the car guide member 14 the surface of the low friction element 36 facing the car guide member 14 is provided as a low friction surface.

In particular, a coating having a low friction coefficient, e.g. a coating based on at least one of polytetrafluoroethylene (PTFE), graphite, polyethylene (PE), ultra-high molecular weight polyethylene (UHMWPE), graphene, polyether ether ketone (PEEK), may be applied to the surface of the low friction element 36 facing the car guide member 14.

In the embodiment depicted in FIGS. 6 to 8, the second member 25 comprises two support elements 38 which are spaced apart from each other in the longitudinal direction. The low friction element 36 is attached to and extends in between said support elements 38.

In order to allow for an easy replacement of the low friction element 36, the low friction element 36 may be attached to support elements 38 using a fixing mechanism which allows for easily detaching the low friction element 36 from the support elements 38. The fixing mechanism in particular may be a snap-on/clamping mechanism.

The use of two support elements 38 is only exemplarily and more or less than two support elements 38 may be used. Similarly, more than one low friction element 36 may be employed.

Further, a second member 25 comprising a low friction element 36 as depicted in FIGS. 6 to 8 additionally may comprise at least one additional (second) permanent magnet 34 and/or at least one roller 30 as depicted in FIGS. 3 to 5. In other words, any combination of at least one second permanent magnet 34, at least one roller 30 and at least low friction element 36 may be employed for reducing the friction between the second member 25 and the guide member 14 in the disengaged state.

Although only elevator safety gears 20 attached to the elevator car 60 have been described with reference to the figures, the skilled person will understand that an elevator safety gear 20 comprising an actuation device 24 according to exemplary embodiments of the invention may also be arranged at a counterweight guide member 15 in case the elevator safety gear 20 is attached to a counterweight 19.

While the invention has been described with reference to exemplary embodiments, it will be understood by those skilled in the art that various changes may be made and equivalents may be substituted for elements thereof without departing from the scope of the invention. In addition, many modifications may be made to adopt a particular situation or material to the teachings of the invention without departing from the essential scope thereof. Therefore, it is intended that the invention shall not be limited to the particular embodiment disclosed, but that the invention includes all embodiments falling within the scope of the dependent claims.

REFERENCES

2 elevator system
3 tension member
4 hoistway
5 drive unit
7*a* landing control panel
7*b* elevator car control panel
8 landing
11 landing door
12 elevator car door
14 car guide member
15 counterweight guide member
19 counterweight
20 elevator safety gear
21 actuation rod
22 braking device
23 first member
24 actuation device
25 second member
26 first permanent magnet
27 activation mechanism
28 stopper element
29 engagement element
34 second permanent magnet
35 magnet holder
36 low friction element
38 support element
60 elevator car
61 upright
62 car roof
63 crossbar
64 car floor
66 car side wall

68 interior space of the elevator car

70 passenger

What is claimed is:

1. An elevator safety gear actuation device (24) for actuating an elevator safety gear (20), the elevator safety gear actuation device (24) comprising:

a first member (23); and a second member (25);

wherein the first and second members (23, 25) are arranged opposite to each other defining a gap for accommodating a guide member (14, 15) extending in a longitudinal direction;

wherein the first member (23) comprises an engagement element (29) which is movable between a disengaged position and an engaged position, wherein the engagement element (29) comprises at least one permanent magnet (26) configured for being magnetically attracted by the guide member (14, 15) extending through the gap and attaching to the guide member (14, 15), when the engagement element (29) is arranged in the engaged position; and wherein the second member (25) comprises at least one additional permanent magnet (34) configured for being magnetically attracted by the guide member (14, 15);

the at least one additional permanent magnet (34) is spaced apart from the guide member (14, 15) and not attached to the guide member (14, 15) when the engagement element (29) is positioned in the engaged position.

2. The elevator safety gear actuation device (24) according to claim 1, wherein the at least one additional permanent magnet (34) provided at the second member (25) is arranged opposite to the at least one permanent magnet (26) provided at the first member (23).

3. The elevator safety gear actuation device (24) according to claim 1, wherein the engagement element (29) is configured for frictionally engaging with the guide member (14, 15).

4. The elevator safety gear actuation device (24) according to claim 1, wherein the first member (23) comprises two stopper elements (28) spaced apart in the longitudinal direction, and wherein the engagement element (29) with the at least one permanent magnet (26) is arranged between the two stopper elements (28).

5. The elevator safety gear actuation device (24) according to claim 1, wherein the second member (25) includes at least one low friction element (36) configured for providing low friction between the second member (25) and the guide member (14, 15) extending through the gap.

6. The elevator safety gear actuation device (24) according to claim 5, wherein the second member (25) comprises at least two support elements (38) spaced apart in the longitudinal direction, and wherein the low friction element (36) is attached to and extends in between the at least two support elements (38).

7. The elevator safety gear actuation device (24) according to claim 5, wherein the low friction element (36) comprises a contact surface facing the guide member (14, 15) extending through the gap, wherein the contact surface in particular is made of a low friction material or covered by a low friction material.

8. The elevator safety gear actuation device (24) according to claim 7, wherein the low friction material is a synthetic material, in particular a material based on at least one of polytetrafluoroethylene, graphite, polyethylene, ultra-high molecular weight polyethylene, graphene, polyether ether ketone.

9. The elevator safety gear actuation device (24) according to claim 1, wherein the second member (25) includes at least one roller (30) configured for rolling along the guide member (14, 15) extending through the gap, wherein the at least one roller (30) in particular is at least partially made of a synthetic material, such as a rubber material.

10. The elevator safety gear actuation device (24) according to claim 9, wherein the second member (25) comprises two rollers (30) configured for rolling along the guide member (14, 15), and wherein the at least one additional permanent magnet (34) is arranged between the two rollers (30).

11. The elevator safety gear actuation device (24) according to claim 1, further comprising an activation mechanism (27) for activating the elevator safety gear actuation device (24), wherein the activation mechanism (27) is configured for causing the engagement element (29) to move from the disengaged position to the engaged position.

12. The elevator safety gear actuation device (24) according to claim 1, wherein the at least one additional permanent magnet configured for counterbalancing magnetic force actuated onto the guide member by the at least one permanent magnet.

13. An elevator safety gear (20) comprising a braking device (22) and an actuation device (24) according to claim 1, wherein the actuation device (24) is mechanically coupled with the braking device (22) in order to be able to actuate the braking device (22).

14. An elevator system (2) comprising at least one counterweight guide member (15) and a counterweight (19) traveling along the at least one counterweight guide member (15) and comprising an elevator safety gear (20) according to claim 13.

* * * * *